United States Patent [19]

Pacura

[11] 4,169,620

[45] Oct. 2, 1979

[54] CAR DOOR LOCK CONTROL

[76] Inventor: Nick Pacura, 921 Wilkinson Ave., Youngstown, Ohio 44509

[21] Appl. No.: 849,870

[22] Filed: Nov. 9, 1977

[51] Int. Cl.[2] ..... E05C 13/00

[52] U.S. Cl. ..... 292/347; 292/1

[58] Field of Search ..... 70/455; 292/1, 347, 292/346

[56] References Cited

U.S. PATENT DOCUMENTS

| | | | |
|---|---|---|---|
| 2,834,628 | 5/1958 | Paparelli et al. | 292/347 |
| 3,082,028 | 3/1963 | Werle | 292/347 X |
| 3,999,788 | 12/1976 | Livingston | 292/347 X |

*Primary Examiner*—Richard E. Moore

*Attorney, Agent, or Firm*—Webster B. Harpman

[57] ABSTRACT

A car door lock control having a sliding protective sleeve that covers the door lock button when it is depressed in the locked position. The sliding sleeve is spring loaded so that it may be pushed down around the button allowing the button to be pulled up to the unlocked position.

4 Claims, 3 Drawing Figures

CAR DOOR LOCK CONTROL

BACKGROUND OF THE INVENTION (1) Field of the Invention

This invention relates to car door lock controls of the tamper proof type that prevent unauthorized entry to the motor vehicle.

(2) Description of the Prior Art

Prior structures of this type have utilized sleeves and covers to block access to the door lock button. See for example U.S. Pat. Nos. 3,501,187, 3,623,758 and 3,999,788.

U.S. Pat. No. 3,501,187 discloses a tubular resilient corrugated cover so formed as to enclose the door lock button. In the present invention a non-resilient spring urged sliding protective sleeve covers the door lock button.

U.S. Pat. No. 3,623,758 discloses a non-movable shroud around a modified door lock button. In the present invention a spring urged sliding sleeve encloses the door lock button in locked position.

U.S. Pat. No. 3,999,788 discloses a pair of telescoping sleeves, the inner one of which can be manually rotated to engage fastener configurations within the outer sleeve. In the present invention, a sliding spring urged sleeve that covers the car door lock button when it is in depressed locked position is movable to expose the door lock button to permit it to be grasped and raised to elevated position.

SUMMARY OF THE INVENTION

A car door lock control comprises a housing positioned in an opening in the car door and around the door lock button and its actuating rod, a spring urged sliding sleeve is positioned within the housing and arranged to enclose the door lock button when said door lock button is in depressed locked position, the sleeve is movable inwardly of the housing against the spring to expose the door lock button to permit it to be grasped and raised to an unlocked position.

DESCRIPTION OF THE PREFERRED EMBODIMENT

Figure 1:
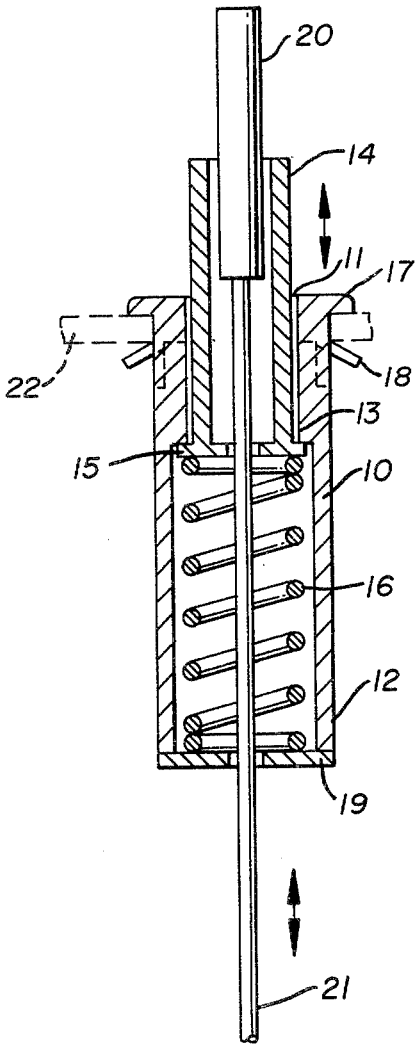
FIG. 1 is a vertical section of the door lock control in unlocked position.

In the form of the invention seen in FIG. 1 of the drawings, the car door lock control comprises a housing 10 having open ends 11 and 12. An area of reduced diameter 13 is formed within the housing 10 inwardly of the open end 11. A sliding sleeve 14 having an outwardly extending annular flange 15 on one end is partially positioned within the housing 10 in the area of reduced diameter 13 and extends outwardly of said housing 10. A spring 16 is positioned within the housing 10 so as to engage the flanged end 15 of the sliding sleeve 14. The spring 16 normally urges the sliding sleeve 14 outward of the housing 10. The housing 10 has an annular flange 17 on its open end 11 and distortable lugs 18 are formed in the side wall of the housing 10 at a point below the annular flange 17. An apertured cap 19 closes the open end 12 of the housing 10 and retains the spring 16. A door lock button 20 on an actuator rod 21 of the car door lock control is positioned axially of the sliding sleeve 14 and housing 10.

Figure 2:
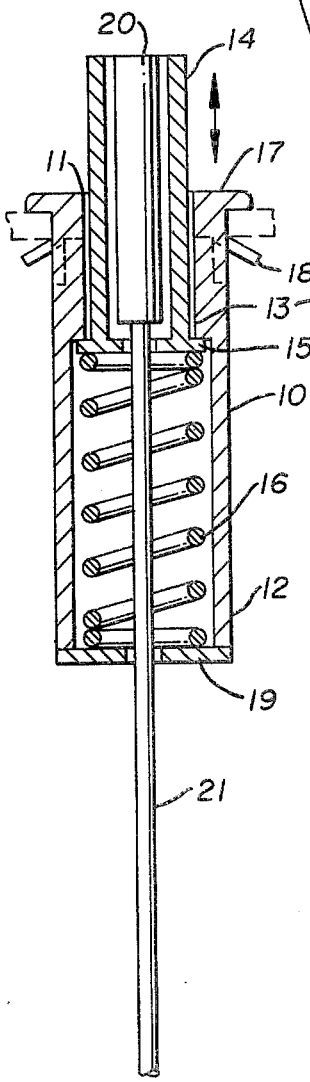
FIG. 2 is a vertical section of the door lock control in locked position.

In use the housing 10 is positioned in an opening in a wall 22 of the car door and secured in place by distorting the lugs 18. By referring to FIG. 2 of the drawings, it will be seen that depressing the car door lock button 20 moves the same into the sliding sleeve 14 where it can not be grasped and moved, thereby preventing unauthorized entry into the car.

Figure 3:
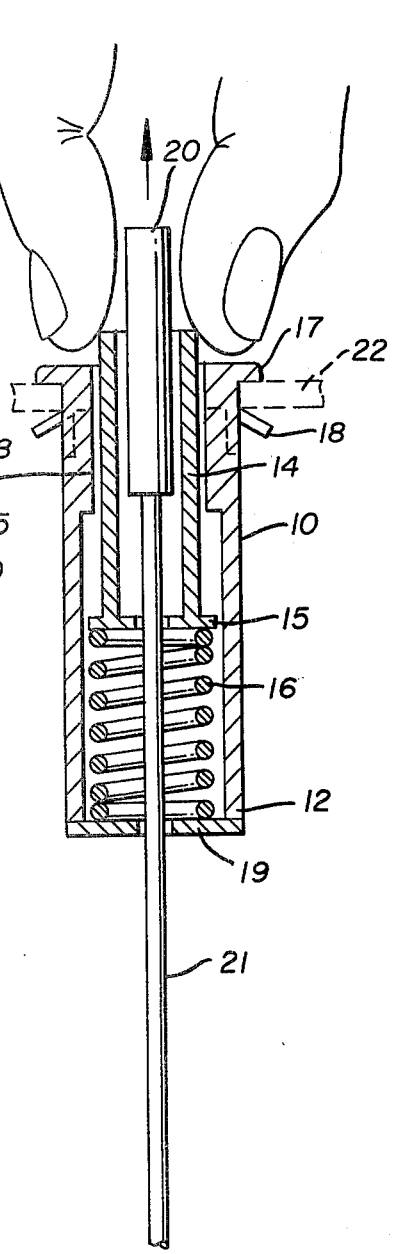
FIG. 3 is a vertical section of the door lock control being manipulated to unlocked position.

In FIG. 3 of the drawings, it will be seen that to unlock the door the sliding sleeve 14 is forced downwardly against the spring 16 allowing the door lock button 20 to be grasped and moved upwardly to unlocked position.

It will thus be seen that a simple and inexpensive car door lock control has been disclosed and that although but one embodiment of the present invention has been illustrated and described, it will be apparent to those skilled in the art that various changes and modifications may be made therein without departing from the spirit of the invention and having thus described my invention,

I claim:

1. A car door lock control for a car door lock mechanism having an actuator rod and a button attached thereto movably positioned in an opening in the car door, said car door lock control comprising a housing vertically positioned in said opening, said housing having an area of reduced diameter extending inwardly of its upper end, a sleeve of a length substantially double that of the area of reduced diameter in said housing freely slidably disposed in said housing and extending outwardly therefrom, and outurned annular flange on the lower end of said sleeve for engaging the portion of said housing defining the area of reduced diameter so as to limit outward movement of said sleeve relative thereto, a spring in said housing normally urging said sleeve outwardly of the housing whereby the actuator rod and button when positioned outwardly of said sleeve can be moved to a locked position within said sleeve and said sleeve can be freely moved into said housing against said spring so as to expose said button.

2. The car door lock control of claim 1 wherein said housing has an annular flange at one end and distortable lugs formed in the side wall of said housing for securing said housing within said opening.

3. The car door lock control of claim 1 and wherein an apertured cap is secured to the end of the housing opposite the area of reduced diameter therein, said actuator extending through said aperture.

4. The car door lock control of claim 1 and wherein the interior of said sleeve is cross sectionally circular and said button on the actuator rod is cross sectionally circular and of a diameter less than the inner diameter of said sleeve.

* * * * *